US005327073A

United States Patent [19]

Hirai et al.

[11] Patent Number: 5,327,073

[45] Date of Patent: Jul. 5, 1994

[54] LOAD-DISPATCHING APPARATUS HAVING IMPROVED POWER SUPPLY CUT-OFF

[75] Inventors: Junji Hirai; Toshihiro Ishibashi; Yuji Nitta, all of Iruma, Japan

[73] Assignee: Kabushiki Kaisha Yaskawa Denki, Kitakyushu, Japan

[21] Appl. No.: 961,705

[22] PCT Filed: May 8, 1992

[86] PCT No.: PCT/JP92/00583

§ 371 Date: Jan. 11, 1993

§ 102(e) Date: Jan. 11, 1993

[87] PCT Pub. No.: WO92/21131

PCT Pub. Date: Nov. 26, 1992

[30] Foreign Application Priority Data

May 21, 1991 [JP] Japan ..... 3-146936

[51] Int. Cl.[5] ..... H01F 27/24

[52] U.S. Cl. ..... 323/362; 323/902; 336/120

[58] Field of Search ..... 323/362, 902; 336/120; 324/207.13; 310/179; 359/180; 340/555

[56] References Cited

U.S. PATENT DOCUMENTS 4,604,575 8/1986 Shimizu et al. ..... 324/208

FOREIGN PATENT DOCUMENTS 61-271806 12/1986 Japan .

62-290113 12/1987 Japan .

*Primary Examiner*—Steven L. Stephan

*Assistant Examiner*—Y. Jessica Han

*Attorney, Agent, or Firm*—Oblon, Spivak, McClelland, Maier & Neustadt

[57] ABSTRACT

A non-contact type load-dispatching equipment having a power supply side core and a receiving side core both provided with a plurality of teeth wound by winding, each of teeth top surfaces formed by respective teeth is oppositely positioned to each other via a gap being magnetically connected for supplying power without contact at the time of power supply, wherein teeth top surfaces of respective teeth of the power supply side core and receiving side core are disposed oppositely on the respective circumferences with a gap therebetween which allows coupling-uncoupling of the cores therethrough;

light signal generating circuit for generating light signals which indicate receiving side voltages is provided in the power receiving side;

voltage signal generation circuit which generates corresponding voltage signals on receiving the light signals and cut-off circuit for cutting off power supply when the generated voltage signal is lower than the predetermined value, where the voltage signal generation and cut-off circuits are provided in the power supply side.

3 Claims, 4 Drawing Sheets

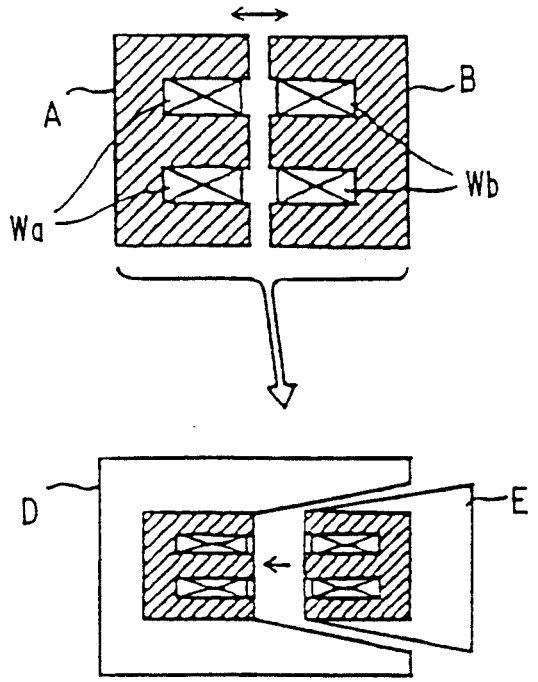
FIG. 1A
FIG. 1B
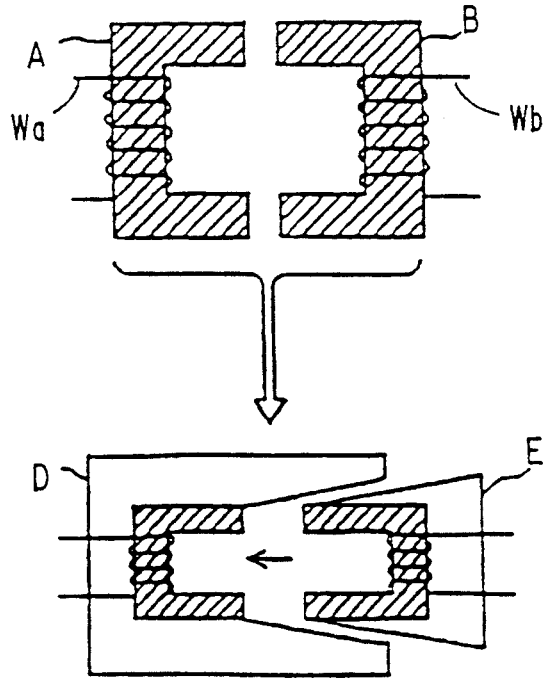
FIG. 2A
FIG. 2B

LOAD-DISPATCHING APPARATUS HAVING IMPROVED POWER SUPPLY CUT-OFF

BACKGROUND OF THE INVENTION

1. Field of the Invention

The present invention relates to non-contact type load-dispatching equipment which supplies power to an autonomous mobile vehicle which is used in an environment wherein power supply by connecting an electrode is difficult, or to an autonomous mobile vehicle used in an ordinary environment wherein contact power supply by connecting an electrode or power supply by a trailing cable (lead wire) to a relatively moving body is difficult due to such reasons as damage, wear, or fatigue, for example, to an electric driverless transportation vehicle or the like which transports goods in a plant.

2. Description of the Related Art

A non-contact type load-dispatching equipment of the conventional type, split core type equipment using magnetic coupling, is known, which type is usually structured to a model with the shell type transformer shown in FIGS. 1A and 1B or to a model with a core type transformer shown in FIGS. 2A and 2B.

These were provided, for example, as shown in Japanese Patent Laid-Open 58-74021 Gazette, for non-contact load-dispatching by coupling power supply and receiving portions with a small gap therebetween, the power supply portion comprising power supply side winding Wa, power supply side core A, power supply side coupler D, and the receiving portion comprising receiving side winding Wb, receiving side core B and receiving side coupler E.

Though there is equipment which supplies electric power from a fixed portion to a rotary portion without contacting thereto as disclosed in Japanese Utility Model Publication 55-15297 Gazette or in Japanese Patent Laid-Open 61-281508 Gazette, all such equipment supplies power to a rotary portion in rotating motion and is not applicable to the autonomous mobile vehicle like the non-contact type load-dispatching equipment which is the object of the present invention.

Therefore, in order to increase transmission magnetic flux within the range of the core material saturation magnetic flux density, it becomes necessary to increase the cross sectional area, thus structurally making it inevitable to make a large frame for the core.

Further, since magnetic flux tends to leak in a butting type coupling as described above, it has been difficult to improve transmission efficiency.

SUMMARY OF THE INVENTION

An object of the present invention is to provide non-contact type load-dispatching equipment whose transmission power for the same volume and its efficiency are remarkably increased compared with the conventional type equipment by increasing the core utilization efficiency of the magnetically coupling portion and reducing leakage flux thereof.

BRIEF DESCRIPTION OF THE DRAWINGS

FIG. 1A is a view showing the structure of a conventional type example of a shell type transformer model.

FIG. 1B shows a conventional shell type transformer model coupling.

FIG. 2A is a view showing the structure of a conventional type example of a core type transformer model.

FIG. 2B shows a conventional core type transformer model coupling.

DETAILED DESCRIPTION OF THE PREFERRED EMBODIMENTS

Figure 3:
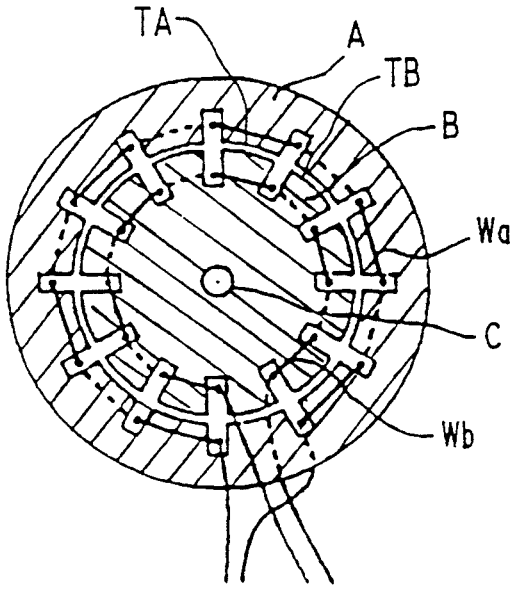
FIG. 3 is a view showing the structure of a non-tapered type embodiment of the present invention.

As an embodiment of the present invention, the embodiment with a rotary electric motor type non-tapered coaxial winding arrangement is first shown in FIG. 3.

Power supply side core A and receiving side core B are formed of a magnetic material, for example, ferrite or amorphous alloy, with a required number of slots and teeth adapted for high frequency use (square wave 10 KHz or more).

Teeth top surface TA of the power supply side core A and teeth top surface TB of receiving side core B are provided with respective teeth facing each other along the circumferences of different diameters, the teeth having power supply side winding Wa and receiving side winding Wb respectively wound around teeth as shown in the figure. In FIG. 3, though it is shown with winding wound a half turn for the sake of simplicity, actually it is wound a predetermined number of times and then shifts to the next tooth. Further, windings Wa, Wb are made of plate-formed or square-formed native copper in order to increase the magneto motive force (AT) within its saturation magnetic flux density, to reduce skin effect due to high frequency, ordinary ohmic loss and stray current between windings.

The load-dispatching operation of the present invention is exactly the same as that of a separately excited DC machine in which revolution is restrained. Though either one of core A or core B can serve as a power supply side (supply side of high frequency current), as a matter of convenience, it will be assumed here that core A is a power supply side and it will be described for the case wherein the receiving side core B is inserted into core A from outside.

Core A and core B are provided oppositely, interposing a narrow gap which allows their easy coupling-uncoupling and a non-magnetic protection film (not shown) which protects the cores and functions as the electrical insulation of the winding. Though it is preferable to get the opposite position wherein respective teeth are positioned face to face with the maximum magnetic interlinkage, the original structure of the present embodiment is a rotary electric motor type, in which the above preferable opposite position is achieved by providing an appropriate current to the receiving side (secondary side) winding when they are coupled (according to circumstances, flow DC, or short-circuits through resistance), and rotating core B in this state to a stable position (that is, the position in which respective teeth are located oppositely).

In other words, this preferable positioning will be satisfied if core B is rotatably disposed, for example, by positioning core B in the center of core A by suspending the axial center of core B with a string, enabling very easy positioning of cores A and B.

Center hole C of core B shown in FIG. 3 is used for controlling the later described load-dispatching equipment, and serves as a passage for transmitting feedback information to the power supply side by means of optical pulse signals for performing sequence control or closed loop control, the information being generated according to the load condition of the secondary side. A control method using this hole will be described later.

Figure 4:
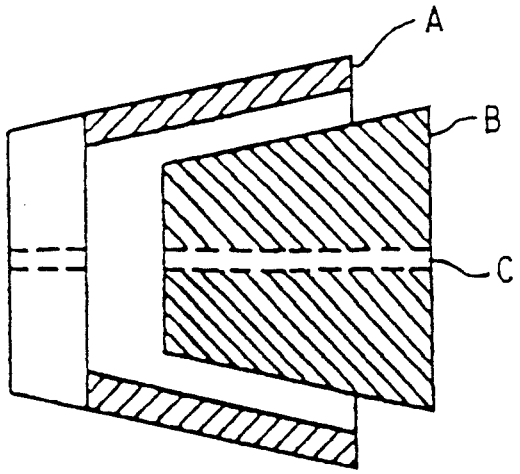
FIG. 4 is a view showing the structure of a tapered type embodiment of the present invention.

As a further preferable embodiment of the present invention, the embodiment is shown in FIG. 4 being structured such that tapered core coupling surfaces are provided so that the diameters of the circles on which the teeth top surfaces are oppositely disposed may change along the center axis of the core coupling surfaces, enabling easy coupling-uncoupling of the cores due to irregularity of alignment and potential gradient thereof. Further, configuration of the tapered portion is not limited to a linear form as shown in the figure, but can be made to a curved form. The windings Wa and Wb are provided on the top surfaces TA and TB of the teeth of the power supply side and power receiving side, respectively, similarly to the arrangement shown in FIG. 3.

Though the embodiment shown in FIG. 4 is structured with a convex type receiving side and a concave type power supply side, it can be formed to a reverse configuration in the same way as the cores, for example, shown in FIG. 3 which are not tapered. Though a plate-formed (or square-formed) coil is wound along a slot, its magnetic flux density toward the center axis is naturally not uniform, therefore even when structured with a single-layer winding, it is possible to generate coupling and uncoupling force if electric current is appropriately provided to the secondary winding.

Though the above description particularly exemplifies the equipment with a single-layer structure, of course it is possible to apply high frequency three phase structure to further increase transmission efficiency per unit volume and make an electric current flow bi-directional to improve commutation ripple.

Figure 5:
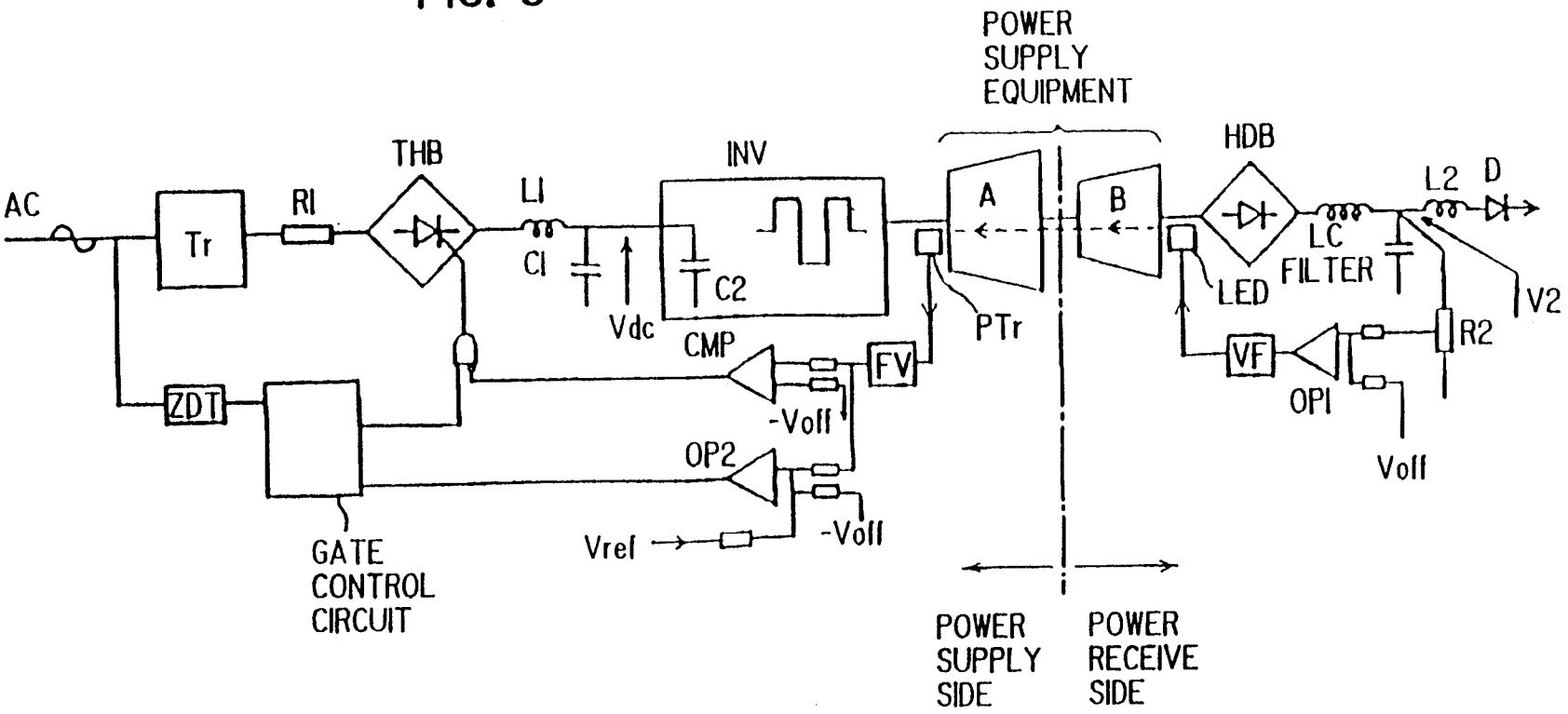
FIG. 5 is a block diagram showing the structure of a control circuit to be used in the present invention.

FIG. 5 is a block diagram showing a drive control unit of the load-dispatching equipment of the present invention.

A.C. voltage supplied a commercial frequency power source AC through main transformer Tr is inputted into thyristor bridge THB through resistance R1 provided for controlling an electric current, and receives waveform chopping control due to later described phase control based on voltage command Vref and secondary voltage feed back. After chopping, the waveform is smoothed and converted to D.C. to reduce voltage pulsation, by capacitor C1, reactor L1 and further capacitor C2 in inverter circuit INV.

In this way, the amplitude of input voltage Vdc of inverter circuit INV is controlled so that secondary voltage V2 will correspond with voltage command Vref.

Inverter circuit INV is provided with a predriver which serves as a reference pulse signal generator for producing a high frequency voltage of 50% duty and a switch composed of MOSFET (or IGBT) (neither are shown), and produces a pulse shape with amplitude of approximately Vdc at a frequency of 10 KHz or more. Application of this high frequency voltage to the above power supply (primary side) winding produces a high frequency rectangular wave voltage in the receiving (secondary side) winding due to magnetic coupling in accordance with a winding ratio between the power supply winding and the receiving winding. This induced voltage is rectified by diode bridge HDB which has a small amount of high frequency loss and ON-state voltage effect, and after passing through LC filter for removing a high frequency vibration component caused by an existing carrier component or stray capacitance, it becomes load side (secondary side) voltage V2. This voltage is supplied to the load through reactor L2 provided for controlling an electric current and via reverse-flow block diode D.

Here, as an example of the most simple system control, a single loop control, that is, control by comparing a feedback value of the load side (secondary side) voltage V2 with command Vref, will be considered. To be concrete, a voltage divided from load side (secondary side) voltage V2 by resistor R2 is added to base offset voltage Voff to be used for shutting off primary side thyristor THB and the sum is inputted into operational amplifier OP1.

Figure 6:
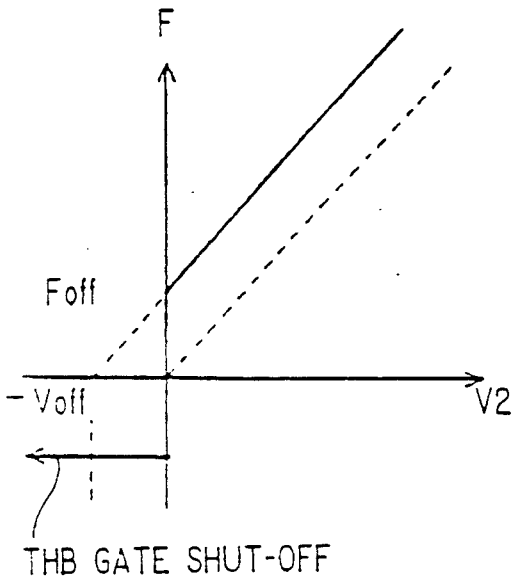
FIG. 6 is a graph describing the photo-feedback operation of the present invention.

The amplified output of operational amplifier OP1 is inputted into voltage/frequency converter VF, and converted into pulse frequency signals by conversion gain shown in FIG. 6. This pulse frequency signal is used as a drive signal of light-emitting diode LED which constitutes a light signal generation circuit together with voltage/frequency converter VF, and the pulse frequency signals are converted into light pulses by means of this LED.

Light pulses emitted from light-emitting diode LED are propagated to the power supply side (primary side) through hole C for light feedback use shown in FIG. 3 and FIG. 4. Light receiving photo-transistor PTr is disposed in power supply side core A at the point where light pulses generated by above LED are propagated, and said photo-transistor PTr receives light pulses (infrared rays) emitted from light-emitting diode LED for conversion into the pulse voltage of the fixed level. This pulse voltage is inputted into frequency/voltage converter FV which constitutes a voltage signal generation circuit together with phototransistor PTr, then converted into a voltage signal which has been added with a voltage corresponding to the above offset by the action of a gain shown in FIG. 6.

Here, description will be made with reference to the above offset.

When the mutual cores are separated, it is necessary to stop supplying power by terminating the excitation of the power supply side (primary side) through shut-off of thyristor bridge THB in order to eliminate consumption of reactive power. Further, in some cases, load side voltage V2 drops to zero volts for some reason (for example, load short-circuit), however in this case, thyristor bridge THB need not be shut off and instead excitation of the power supply side (primary side) is controlled so as to stay within the rating of the power element constructing inverter circuit INV.

Thus, it is necessary to change the method for shutting off the line according to circumstances. When frequency/voltage conversion is merely performed without adding the offset, the same voltage (in FIG. 6, zero volts) is outputted in some state such as the gain shown by the broken line in FIG. 6, thus failing to distinguish the state.

According to the present embodiment, it has become possible to change the power supplying state by distinguishing each state by adding the offset.

When mutual cores are separated, of course light pulses generated by light-emitting diode LED are not received by photo-transistor PTr, and frequency/voltage converter FV outputs −Voff by the gain shown in FIG. 6.

On the other hand, when each core is coupled and load side voltage V2 becomes zero due to load short-circuit or the like, then the output voltage of converter FV also becomes zero.

Thus the completion of core coupling is distinguished by the existence of offset Voff to change power supply state.

To be concrete, a control method is applied that by comparing the values of above FV output and Voff by means of comparator CMP which constitutes a shut-off circuit together with thyristor bridge THB, a gate signal of THB is shut off when it is judged that (V2+Voff-)<Voff.

FV output, an offset cancel voltage of reversed polarity, and voltage command (Vref) are inputted into operational amplifier OP2, and amplified differential signals are transmitted through a limiter to become phase signals of a gate control circuit which are gained by timer measurement synchronized to a commercial frequency zero point obtained by ZDT (zero point detector). According to the above process, feedback is completed with reference to load side voltage V2.

Now, in the above embodiment, though the shut-off circuit for breaking power supply is composed of a comparator and a thyristor bridge, there are semiconductor elements such as GTO, a power transistor, power FET which can be used in place of the thyristor bridge, and the shut-off circuit may be constructed by using any of these substitutes.

As for control and protection features, it is desirable to feed back and reflect much more secondary information to the control function, for example, such information as a battery temperature, charging current (when a battery is charged at the secondary side), and power supply effective value.

Though increased feedback information is required for performing these delicate controls, it is possible to cope with these requirements by means of techniques such as time-division or multichannel light feedback operation.

Further, it is possible to employ PWM control for control of the power supply side corresponding to load side voltage V2 when consideration is given to use of center tapped winding or the like to meet core asymmetrical magnetization.

As described above, the non-contact type load-dispatching equipment of the present invention has a core and winding structured on the concept of a rotary electric motor, not on a transformer, so that combination of the primary and secondary flux are strengthened in the coupled condition, and hence transmission power and transmission efficiency per unit volume of the power supply core are increased. Further, when the respective core coupling surfaces are tapered and an appropriate electric current is caused to flow in the primary and secondary windings, repulsive and sucking forces are generated therebetween, thereby making coupling-uncoupling of the core easy to carry out. Still further, since the light signal from the secondary side (power receiving side) can make the secondary voltage correspond with the voltage command, it is possible to supply power in an atmosphere wherein power supply by connection/disconnection of an electrode is difficult such as an explosive atmosphere, in water or in vacuum where air-tightness is highly required, for example, at a chemical plant, an explosive gas generation site, a gasoline station, space, a submarine in water or a pump in water.

Furthermore, the equipment of the present invention can be employed in the ordinary atmosphere wherein contact power supply by connecting electrode or power supply by a trailing cable (lead wire) to a relatively moving body is difficult due to such reasons as damage, wear, fatigue, (for example, power supply to a tool portion of a machining center or to each axis of a multiple axes robot).

Moreover, when mutual cores are separated and optical signals are not propagated to the primary side (supply side), the thyristor bridge for generating the supply voltage is shut off, accordingly the equipment of the present invention can prevent consumption of reactive power.

As described above, the present invention makes it possible to effect non-contact type load-dispatching in various cases which have been deemed not suitable for such load-dispatching, and also makes it possible to prevent consumption of reactive power, thereby largely contributing to industry.

What is claimed is:

1. A non-contact type load-dispatching apparatus having a power supply side core and a power receiving side core both provided with a plurality of teeth wound by winding, wherein each of a plurality of teeth top surfaces formed by respective said teeth is oppositely positioned to each other being magnetically connected for supplying power without contact at the time of power supply, comprising:

teeth top surfaces of respective teeth of said power supply side core and receiving side core disposed oppositely on the respective circumferences with a gap therebetween which allows coupling-uncoupling of said cores therethrough;

a light signal generation circuit, provided in said power receiving side, for generating light signals which show receiving side voltages;

a voltage signal generation circuit for receiving said light signals and for generating corresponding voltage signals; and a cut-off circuit for cutting off power supply when one of said generated voltage signals is lower than a predetermined value, wherein each of said voltage signal generation and cut-off circuits is provided in the power supply side.

2. A non-contact type load-dispatching apparatus according to claim 1, wherein:

circles on which said teeth top surfaces are oppositely disposed are structured with diameters varying along the center axis thereof.

3. A non-contact type load-dispatching apparatus according to claim 1 or 2, wherein:

holes for propagating light signals generated by said light signal generation circuit to said voltage signal generation circuit at the time of power supply are provided in the power supply side core and the power receiving side core, respectively.

* * * * *